United States Patent [19]

Perry

[11] Patent Number: 5,063,625

[45] Date of Patent: Nov. 12, 1991

[54] ADJUSTABLE TENSIONING OF A MATTRESS

[76] Inventor: Leroy R. Perry, 1301 E. Rubio St., Altadena, Calif. 91001

[21] Appl. No.: 523,480

[22] Filed: May 15, 1990

Related U.S. Application Data

[63] Continuation-in-part of Ser. No. 335,508, Apr. 10, 1989, Pat. No. 5,027,459.

[51] Int. Cl.[5] ..... A47C 27/045

[52] U.S. Cl. ..... 5/475; 5/447; 5/261; 267/89

[58] Field of Search ..... 5/260, 261, 262, 446, 5/447, 475, 464; 267/89

[56] References Cited

U.S. PATENT DOCUMENTS

| | | | |
|---|---|---|---|
| 71,014 | 11/1867 | Huntington | 5/261 |
| 1,404,031 | 1/1922 | Kelman | 5/261 |
| 2,384,097 | 9/1945 | Klazkin | 5/447 |
| 2,663,360 | 12/1953 | Ory | 267/89 |
| 2,673,357 | 3/1954 | Brandwein | 5/447 |
| 2,724,842 | 11/1955 | Rogovy | 5/261 |
| 2,773,270 | 12/1956 | Rozelle | 5/447 |
| 2,874,390 | 2/1959 | Stone | 5/447 |
| 3,085,259 | 4/1963 | Sandor | 5/447 |
| 3,273,877 | 9/1966 | Geller et al. | 267/89 |
| 3,490,084 | 1/1970 | Schuster | 5/261 |
| 3,608,107 | 9/1971 | Kentor et al. | 267/89 |
| 3,893,198 | 7/1975 | Blair | 5/446 |
| 4,094,025 | 6/1978 | Nystad | 5/446 |

FOREIGN PATENT DOCUMENTS

| | | | |
|---|---|---|---|
| 709755 | 5/1965 | Canada | 5/446 |
| 40407 | 8/1887 | Fed. Rep. of Germany | 5/261 |
| 91462 | 3/1896 | Fed. Rep. of Germany | 5/446 |
| 1417878 | 12/1964 | France | 267/89 |

*Primary Examiner*—Eric K. Nicholson

*Attorney, Agent, or Firm*—William W. Haefliger

[57] ABSTRACT

A mattress construction includes upper and lower structures defining generally parallel planes, and coil springs operatively connected to such structures and located between those lanes, and with at least one of the upper and lower structures including a first tensionable sheet; a member or members extending at the periphery of the mattress and connected with the first tensionable sheet to interact therewith and transmit force for tensioning the tensionable sheet; and a device for adjusting the tension exerted by said member or members. The mattress construction also enables treating of a patient having a spinal condition for which traction is recommended by suspending the patient's body to extend generally horizontally on a "trampoline" grid mattress surface which interacts with the mattress border perimeter structure to create a surface lift and therefore stretch reflex on the patient's body. This surface lift is transmitted vertically in a rebound proportional to the weight and movement of the body or bodies on it to further transmit forces horizontally to the perimeter border surface and substructures creating an elongation and decompression of the patient's spine.

23 Claims, 6 Drawing Sheets

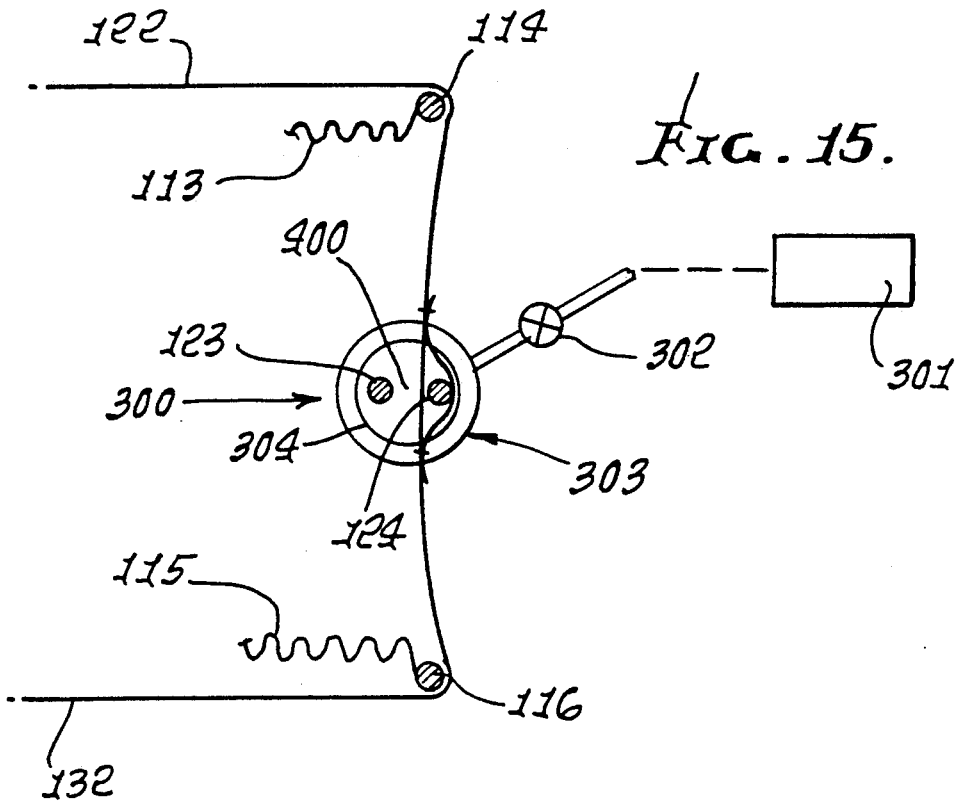
FIG. 15.
FIG. 14.
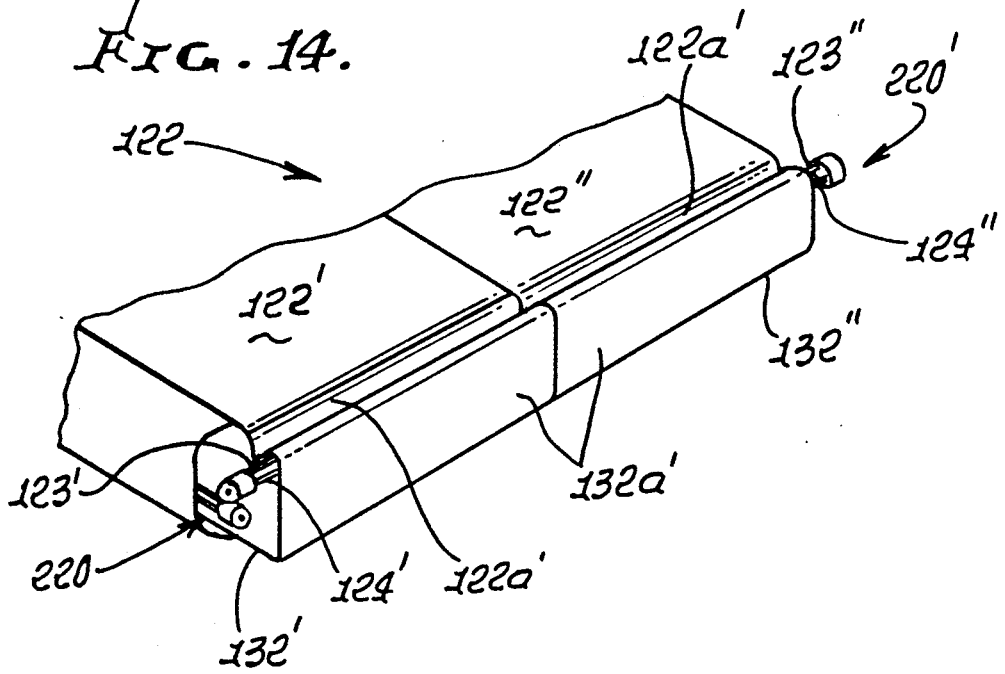

ADJUSTABLE TENSIONING OF A MATTRESS

BACKGROUND OF THE INVENTION

This application is a continuation-in-part of U.S. application Ser. No. 335,508 filed Apr. 10, 1989 now U.S. Pat. No. 5,027,459.

This invention relates generally to mattresses, and more particularly to easily operable means to increase the "firmness" of mattresses. It can be applied to any structure or mechanism which supports the body, i.e., seats, sofas, etc.

There is need for mattress constructions in which the firmness or hardness of the mattress is determined by means other than the strength or number of coil springs used. While it is known to provide a wire mesh overlying the coil springs of the mattress, no way was known to employ a sub-frame and to tension it by interaction with the periphery of the mattress, and in the simple, easily adjustable manner provided by the present invention. Also, no way was known to enable ready detachment of a mattress stiffening wire mesh from the main mattress.

SUMMARY OF THE INVENTION

It is a major object of the invention to provide an improved mattress construction meeting the above need.

It is another object to provide an adjustably tensionable grid or sheet mechanism for application to a mattress, the grid or sheet being easily attachable to the mattress.

The invention is incorporated in a mattress construction including upper and lower structures defining generally parallel planes, and coil springs operatively connected to the structures and located between the planes, and includes:

a) at least one of the upper and lower structures defining a first tensionable sheet, b) first means extending at the periphery of the mattress and connected with the first tensionable sheet to interact with it and to transmit force for tensioning the tensionable sheet, c) and means for adjusting the tension exerted by the first means.

As will appear, an adjustable crank/ratchet mechanism may be used to control firmness, lift, stretch, rebound, and decompression of the person's spine and associated anatomy. In this regard, there is a need for patients with spinal compression to have a variable adjustable mattress surface to reduce or increase surface lift, tension or rebound on the surface, trampoline, grid or surface structure to decompress the patient's spine and associated anatomy, to reduce spinal compression and alleviate pain resulting from spinal disc, nerve, vascular, and associated anatomical compression. Burn victims and patients who must lie in bed due to illness or other reason often suffer from vascular, neurological and soft tissue injury, including decubitis ulcers and other such compression syndromes due to the pressure of their mattress. This can be alleviated, controlled or altered to improve proper physiological response, including increased circulation and neuromuscular reeducation and homeostasis, through the use of a mechanically altering and adjustable surface tension made possible by the crank/ratchet mechanism associated with a mattress.

Further, the principles of the invention are particularly applicable to hospital beds which must bend at varied locations of the mattress. By using a hand crank/ratchet, electrical, or pneumatic/hydraulic system, pressure upon the surface top/bottom of the mattress can be altered, bent or positioned to create firmness, tensioning, or lift, and can be controlled for the physiological benefits of the patient.

It is a further object of the invention to provide an improved grid which incorporates a looping sub-frame to which grid wires are attached, the sub-frame then being easily attachable to the main outer frame of a mattress. In this regard, non-metallic band means may be employed for securing such attachment in an easy, load distributing manner for tensioning the grid and its sub-frame. This also facilitates ease of removal of the grid by ready detachment of the band means.

As will appear, the band means may include multiple bands which are spaced apart and extend to different locations of support at the periphery of the mattress; the bands may consist of flat, flexible fabric of high tensile strength or metal band or other materials to produce greater rigidity; and they may easily be secured to the main frame by looping connection about a frame member.

It is a further object to provide band connection configurations that interact with both upper and lower outer frames of the mattress; and a third such frame may be employed between the upper and lower outer frames to interact with the bands, as during imposition of loading on the mattress to tension the grid and its sub-frame.

Both upper and lower grids, and sub-frames, may be provided, and the bands may interconnect them in a tensioning mode, with band interaction via the main frame members of the mattress, as will be seen.

These and other objects and advantages of the invention, as well as the details of an illustrative embodiment, will be more fully understood from the following specification and drawings, in which:

DRAWING DESCRIPTION

FIG. 1 is a perspective view of a mattress embodying the invention;

FIG. 1*a* is a plan view of a plastic grid;

FIG. 14 is a perspective view of a sectioned mattress, adjustably tensionable; and FIG. 15 is an elevation showing actuator operation of rod means.

DETAILED DESCRIPTION

Figure 1:
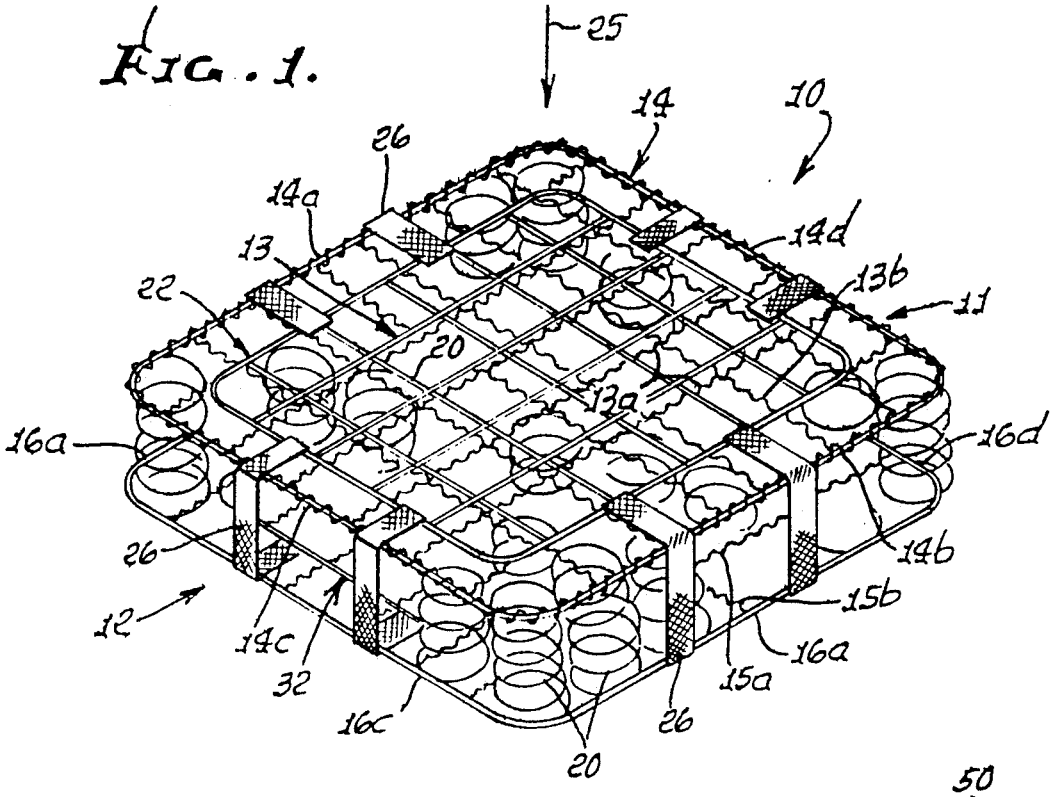
Figure 3:
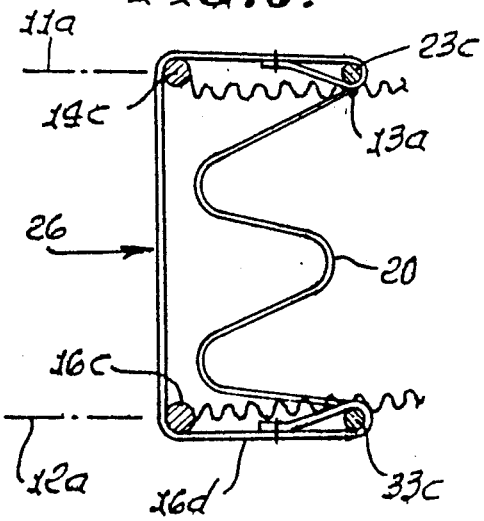
FIGS. 3–6 are schematic, fragmentary elevations showing tensioning of grids by various band arrangements, FIG. 3 taken on lines 3—3 of FIG. 2.
Figure 2:
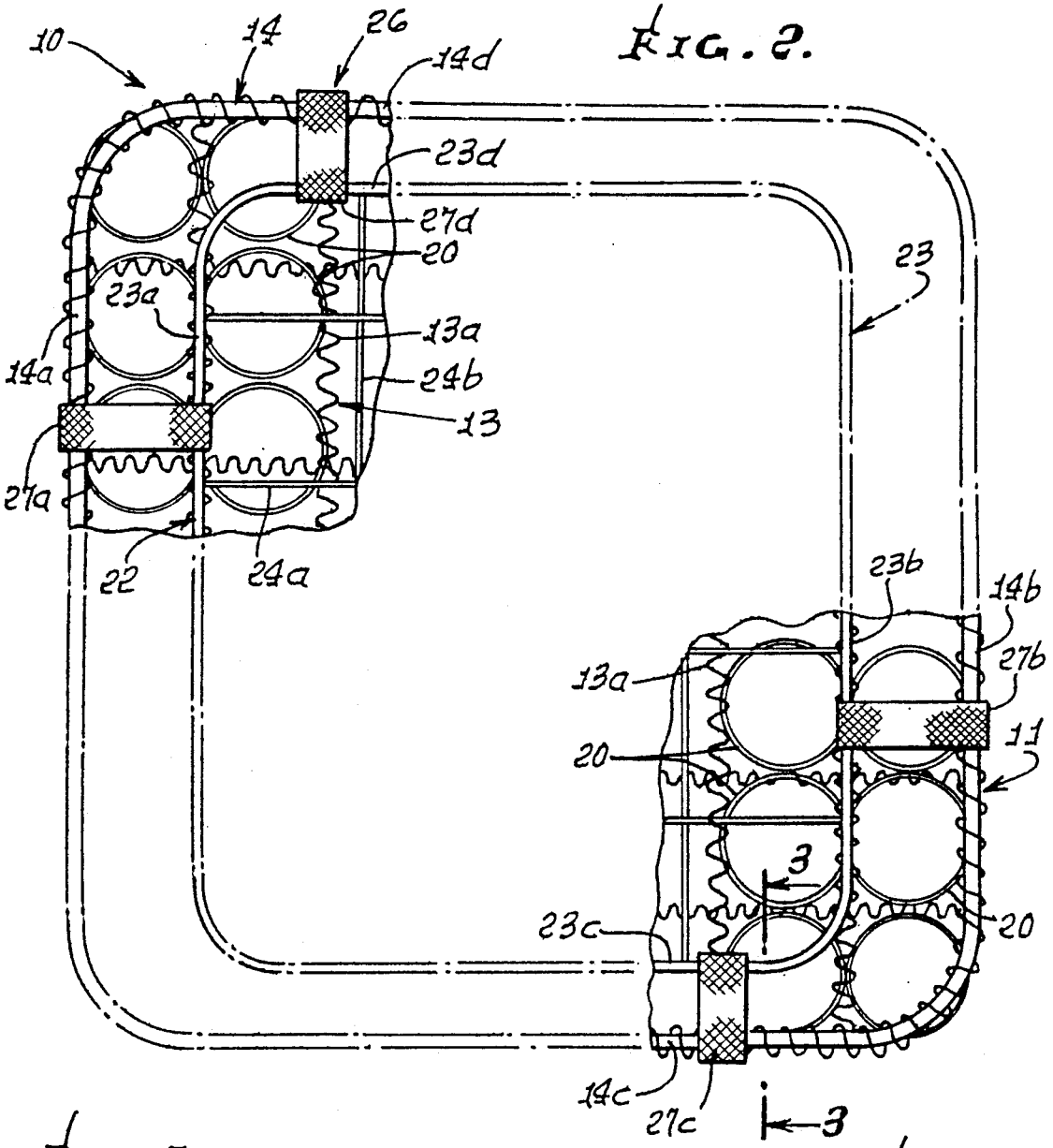
FIG. 2 is a top plan view of a corner portion of the mattress.

In FIGS. 1-3, a mattress construction 10 includes upper and lower structures 11 and 12 defining generally parallel planes 11*a* and 12*a*. Metallic coil springs 20 are positioned between 11 and 12 in lateral and longitudinal rows as is clear from FIG. 2 and the tops and bottoms of the springs are attached to such structures 11 and 12. For example, structure 11 includes an upper mesh 13 integrated with heavy metal looping upper frame 14, the latter including longitudinal horizontal lengths 14*a* and 14*b*, and lateral horizontal lengths 14*c* and 14*d*. Mesh 13 includes elongated longitudinal strands 13*a* and elongated lateral strands 13*b*. Those strands 13*a* and 13*b* typically define tight, small coils along their lengths. The ends of coiled strands 13*a* are connected to frame lengths 14*c* and 14*d*; and the ends of coiled strands 13*b* are connected to frame lengths 14*a* and 14*b*.

Similarly, structure 12 includes a lower mesh 15 integrated with heavy metal looping lower frame 16, the latter including longitudinal horizontal lengths 16*a* and 16*b*, and lateral horizontal lengths 16*c* and 16*d*. Mesh 15 includes elongated longitudinal strands 15*a* and elongated lateral strands 15*b*. Those strands 15*a* and 15*b* typically define tight coils along their lengths.

In accordance with one aspect of the invention, the upper structure 11 includes a first grid 22, seen in FIG. 2, as overlying the mesh 13. That grid includes a sub-frame 23 extending in a loop and having heavy sub-frame longitudinal lengths 23*a* and 23*b*, and lateral lengths 23*c* and 23*d*. The latter are respectively spaced inwardly from frame lengths 14*a*-14*d*, as shown. The first grid 22 also includes mesh strands 24*a* and 24*b*, the strands 24*a* consisting of wires that extend longitudinally with their ends connected to 23*a* and 23*b*; and the strands 24*b* consisting of wires that extend laterally with their ends connected to 23*a* and 23*b*. Wires 24*a* are preferably of heavier gage than wires 24*b*, or 24*b* may be of heavier gage than 24*a*.

Further, in accordance with the invention, means is provided to extend at the periphery of the mattress and to be connected with the first grid, to interact with same and transmit force for tensioning the first grid, i.e., laterally and/or longitudinal for example. This enables the first grid and to resist deflection vertically under loading imposed vertically (see arrow 25 in FIG. 1), thereby adding materially to the "hardness" of the mattress, as desired by many persons. According, an existing "soft" mattress, as in FIG. 1, can easily be converted to a harder mattress by use of the first grid 22.

Such means attaching the grid 22 to the mattress typically includes band means extending from the frame lengths 23*a*-23*d* of the first grid to different portions of the mattress periphery. As shown in FIG. 2, the band means is seen to include multiple flat bands or straps 26 which are spaced apart to extend at different locations (27*a*-27*d* for example) of support at the periphery of the mattress. Each band typically and preferably consists of strong, flexible, flat fabric, one good example being TEFLON, or metal band or other materials to produce greater rigidity, the band being between ½ and 1 inch in width, and having its opposite ends wrapped about and attached to frame and sub-frame lengths. The flatness of the bands prevents snagging with bedding, such as padding placed upon the mattress. Also, the bands 26 position as well as tension the grid 22 in use. The bands may be stapled, crimped or looped to frame lengths 23*c* and 14*c* for example. The bands remain tensioned during mattress deflection.

In FIG. 3, the band 26 wraps partly about 14*c* and 16*c*, and then also extends at 16*d* toward a lower grid 32, i.e., toward frame length 32*c* for attachment thereto. Thus, both grids 32 and 22 interact with one another, and with the frame lengths 14*c* and 16*c*, under imposed loading to tension the grids. Lower grid 32, which is part of 12, has the same construction as the upper grid 22, with corresponding elements as follows (multiple bands connect the upper and lower frames):

| Upper Grid | Lower Grid |
|---|---|
| 22 | 32 |
| 23 | 33 |
| 23a | 33a |
| 23b | 33b |
| 23c | 33c |
| 23d | 33d |

Figure 4:
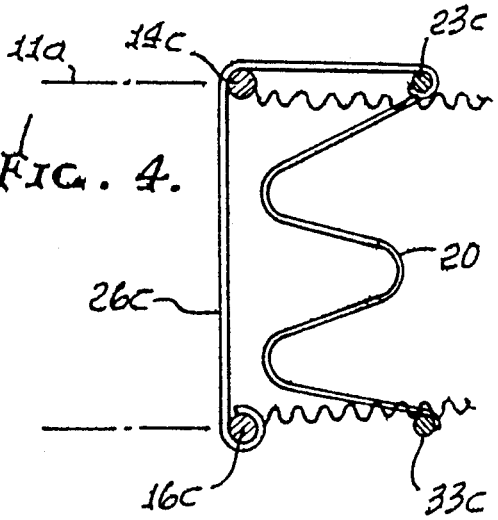
Figure 5:
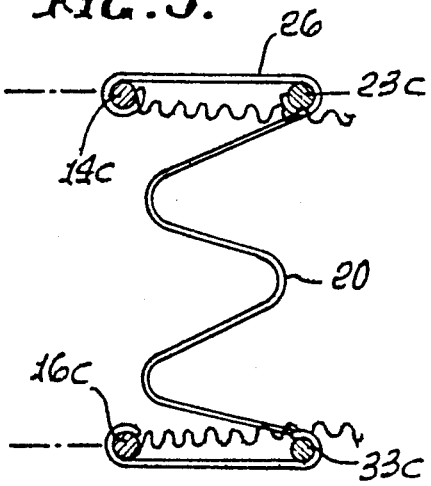

In FIG. 4, the band 26 is attached at 26*a* to grid frame length 23*c*; it extends toward and wraps partly about frame length 14*c*, and then extends downward at 26*c* for wrapping about and attachment to lower frame member 16*c*. This causes interaction between both frame members 14*c* and 16*c* and the grid 22, under imposed loading, for tensioning the grid. Also, the bands hold the frames 14 and 16 in predetermined spaced relation in the absence of loading but tensioned toward one another. In FIG. 5, separate upper and lower bands 26 are provided, upper band 26 connecting 14*c* and 23*c*, and lower band 26 connecting 16*c* and 33*c*. Multiple of such bands 26 are spaced adjacent the mattress on all four sides.

Figure 6:
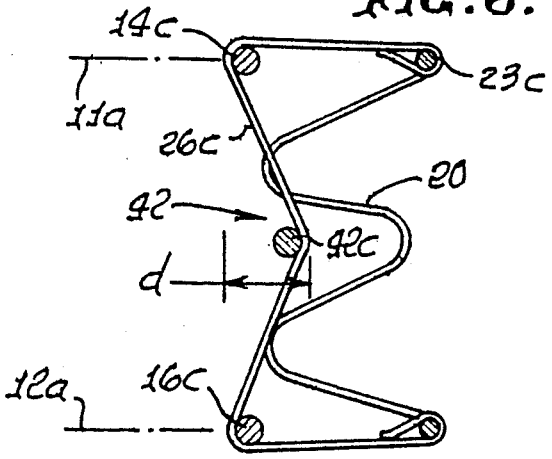

In FIG. 6, the construction is the same as in FIG. 3, but an additional or third frame 42 forms a loop with four lengths 42*a*-42*d*, each spaced inwardly of the mattress periphery, as by distance "d", and spaced between planes 11*a* and 12*a*. The band lengths 26*c* loop partly about the length 42*a*-42*d*, at their inward facing sides, tending to pull those lengths outwardly at all times, since the bands are tensioned at all times. In this way, the two grids 22 and 32 both interact with and are tensioned by all these frames 22, 32 and 42, under imposed loading, and the bands position the frames.

Figure 1A:
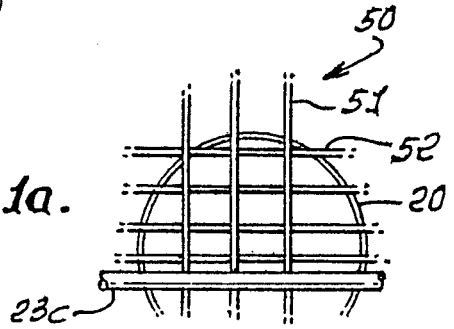

Finally, an additional unitary grid consisting of longitudinal and lateral strands of plastic, may be provided as at 50 in FIG. 1*a*. The strands 51 and 52 are fused together at their interconnections, and the grid 50 is not peripherally connected to the mattress but merely meshes with or underlies the grid 22 to cushion same. Grid 50 is retained in position by tensioned grid 22. Grid 50 extends in superimposed relation to grid 22 and is retained between the grid 22 and the coil springs. The invention may be considered to relate generally to rehabilitation equipment and to apparatus usable in conjunction with a mattress to aid or achieve therapeutic decompression of the spine. The problem of decreasing pressure on the spine, discs, nerve roots, and associated anatomy to relieve pain is a continuing one. There is abundant need for effective apparatus and techniques to achieve and/or facilitate such pain relieving spinal decompression, which the present invention meets.

Figure 12:
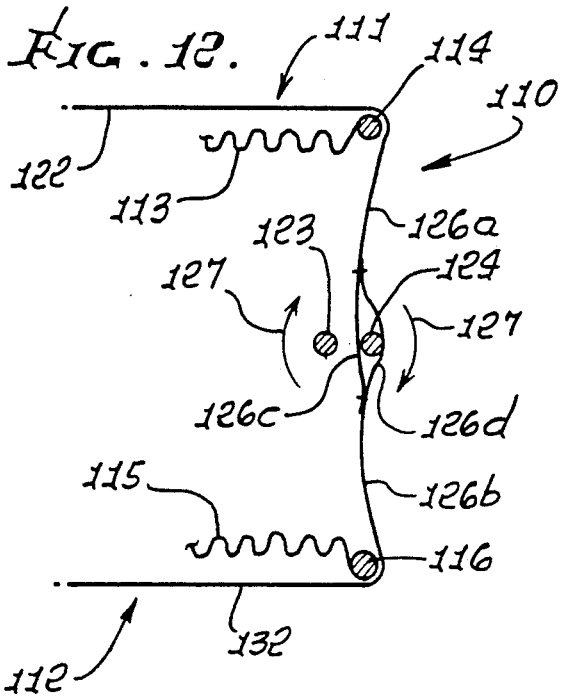
FIGS. 12 & 13 are schematics showing how tensioning is achieved.
Figure 11:
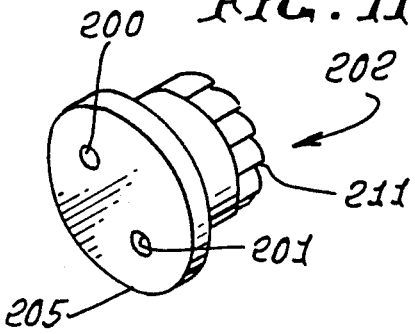
FIG. 11 is an enlarged perspective view of a rotor shown in FIGS. 9 and 10.
Figure 13:
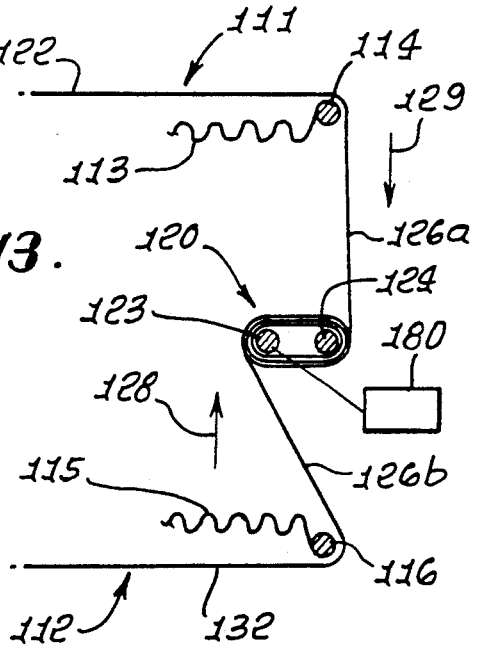

Referring now to FIGS. 12 and 13, mattress (or trampoline) 110 may have the same general side construction of FIGS. 3-6, including upper and lower structures 111 and 112 defining generally parallel planes. Structure 111 includes an upper mesh 113 (corresponding to mesh 13)

integral with heavy metal looping upper frame 114 (corresponding to frame 14). Mesh 113 includes elongated strands, such as indicated at 13*a* and 13*b* above. Similarly, lower structure 112 includes a lower mesh 115 (corresponding to mesh 15). Mesh 115 includes elongated strands, such as indicated at 15*a* and 15*b* above, and integral with heavy metal looping lower frame member 116.

Upper structure 111 includes a first controllably tensionable sheet member 122 (a continuous sheet or a grid) seen as overlying mesh 113; and lower structure 112 includes a second controllably tensionable sheet member 132 (a continuous sheet or grid) seen as underlying mesh 115. Such controllable tensioning of upper and lower sheets 122 and 132 achieves variable "hardness" of these mattresses, i.e., provide a means to achieve therapeutic decompression of the spine of a person lying on the mattress.

The means to adjust sheet tension is shown at 120 in the form of two elongated rods 123 and 124 extending parallel with the side of the mattress generally between frame members 114 and 116, together with upper sheet extension 126*a* and lower sheet extension 126*b*, extending adjacent the rods 123 and 124 to wrap about them as the rods are rotated, as indicated by arrows 127 in FIG. 12. Note that the sheet extensions may be interconnected by sheet portions or bands at 126*c* and 126*d* and confine rod 124 therebetween. The resultant wrap is seen in FIG. 13, and may be regarded as floating between 114 and 116, in the sense that the up-tension indicated by arrow 128 is equal to the down tension indicated at 129. As will be seen, a lock means is provided to lock the adjustably rotated rods in any selected wrap position to produce the desired sheet tension at the top and/or bottom of the mattress. The rod lock means is schematically indicated at 180 in FIG. 13.

Figure 7:
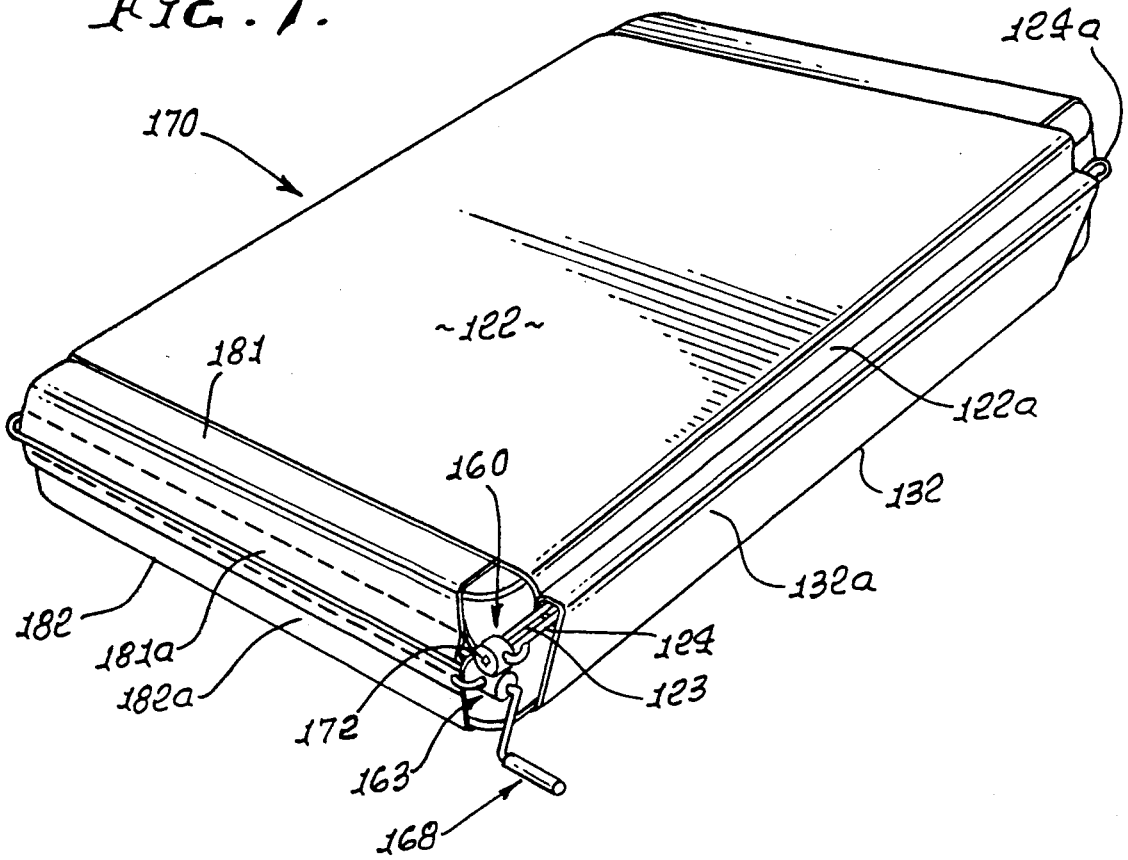
FIGS. 7 is a perspective view showing adjustability of a grid or sheet on a mattress.
Figure 8:
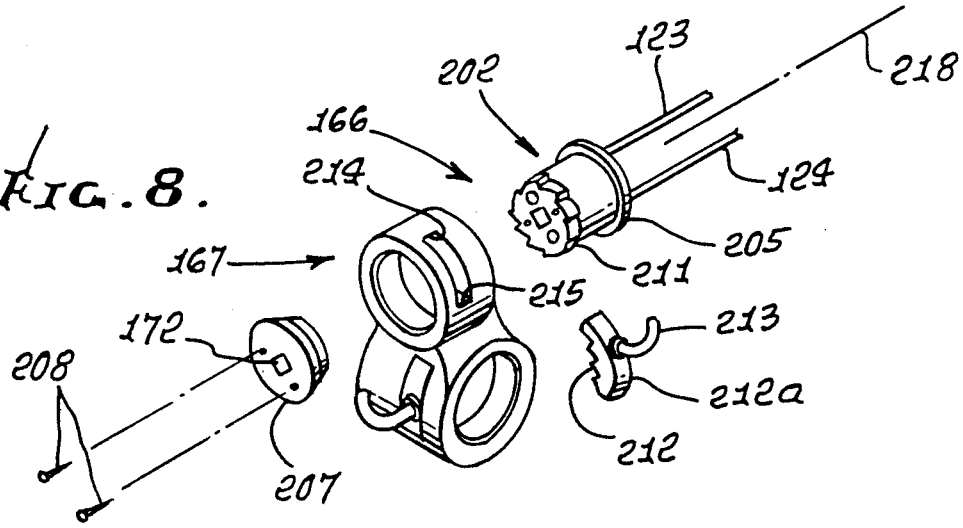
FIG. 8 is an enlarged perspective view showing, in exploded form, elements of mechanism to relieve such adjustability.
Figure 9:
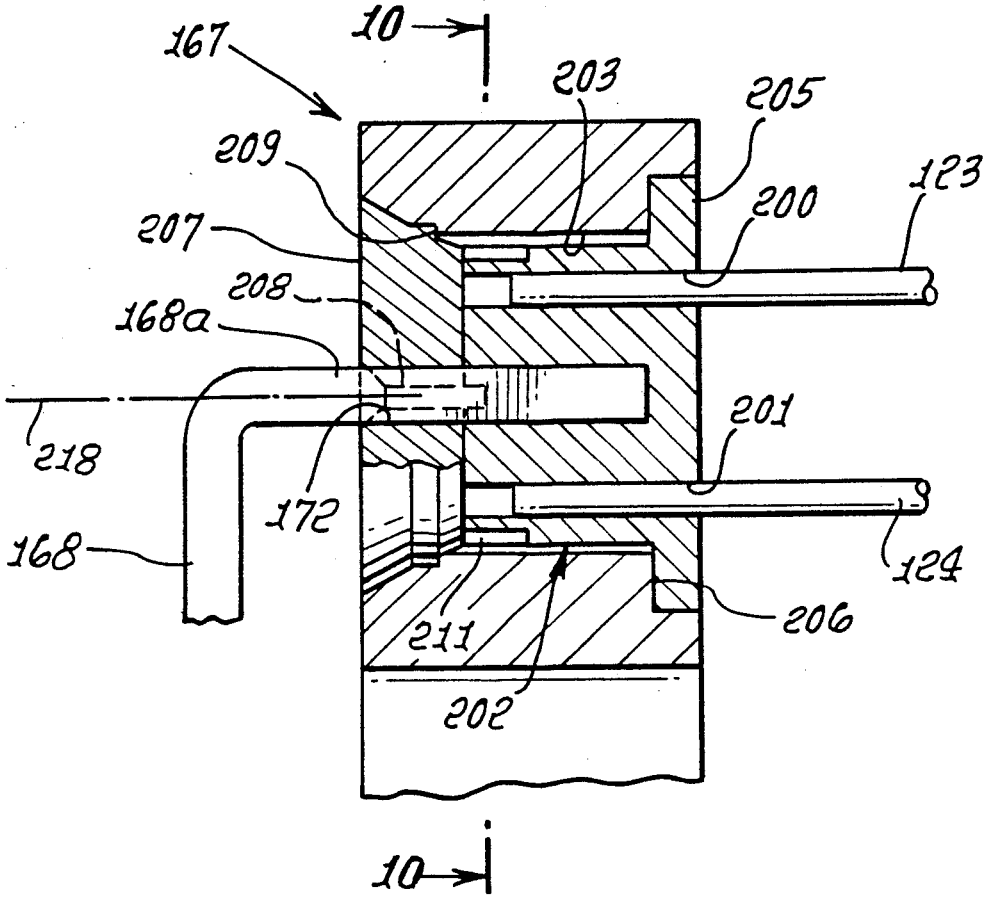
FIG. 9 is a side elevation showing, in section, elements of the adjusting mechanism.
Figure 10:
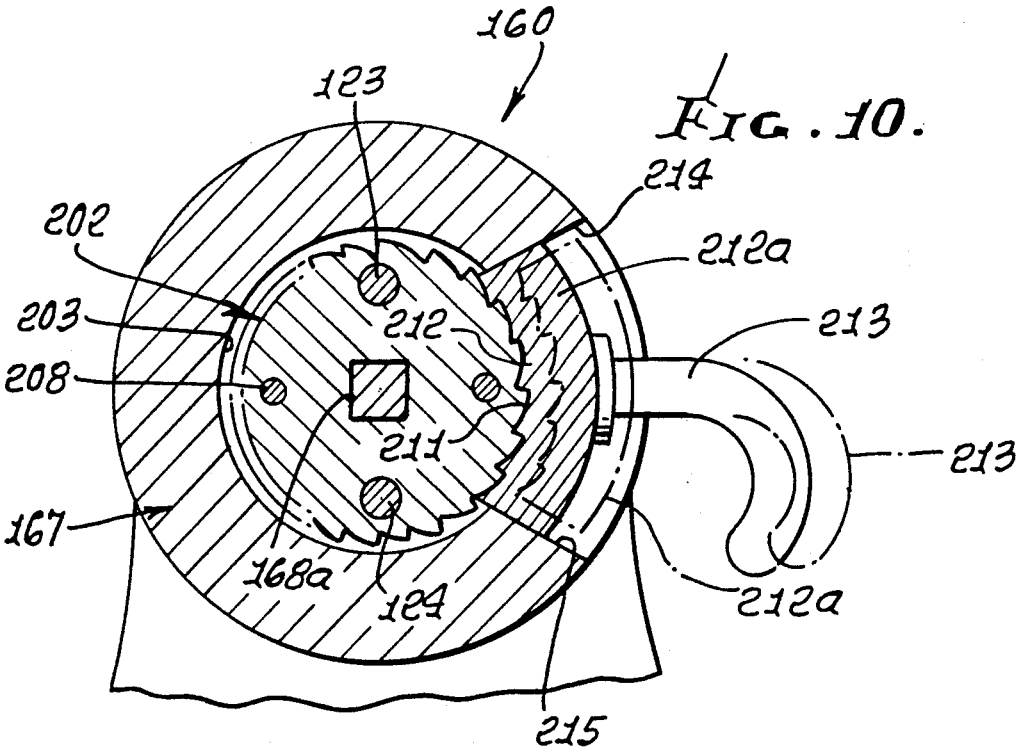
FIG. 10 is a section taken on lines 10—10 of FIG. 9.

Referring now to FIG. 7, elements the same as those in FIGS. 12 and 13 are given the same identifying numerals. Mechanism 160 to rotate and lock the rods is located at one end of the two-rod combination, and the opposite ends of the rods may be joined together as indicated at 124*a*. Such ends extend along the length of the mattress 170 at one side thereof. A similar apparatus 163 includes two rods extending along one end of the mattress 170, and rod rotating and locking mechanism 166 integral with the same housing 167 as is mechanism 160. Either or both mechanisms can be hand cranked using the same crank means 168. Thus, the end of the crank pin 168*a* can be inserted into either socket 172 (associated with mechanism 160) or a similar socket (associated with mechanism 163).

Apparatus 163 is employed to controllably tension the upper and lower sheets 181 and 182 running lengthwise of the mattress beneath sheets 122 and 132, respectively. Sheets 181 and 122 have extensions 181*a* 182*a* that wrap about the rods of apparatus 163, in the same way that extensions 122*a* and 132*a* wrap about rods 123 and 124. Housing 167, and the two sets of rods "float", as described above.

Referring now to FIGS. 8–11, the ends of rods 123 and 124 fit into bores 200 and 201 formed on a clutch rotor 202 received within a bore 203 in the housing. A flange 205 on the rotor engages housing shoulder 206 to position the rotor axially in the housing in one direction. A cap 207 is attached to the opposite end of the rotor as by a fastener o fasteners 208, and engages housing shoulder 209 to position the rotor axially in the housing in the opposite direction.

The clutch rotor has a series of circumferentially spaced, outwardly presented clutch shoulders or teeth 211 which are engageable by teeth 212 on a latch dog 212*a* carried by the housing. A handle 213 on the latch dog may be pulled (retracted) radially outwardly to move the dog teeth clear of the clutch teeth (to allow release of the rotor so that the rotor may rotate to relieve the tensioning of the rods and sheet); alternately, the handle 213 may be pushed radially inwardly to move the dog teeth into position engaging teeth 211 to join or lock the rotor in the housing (thereby to clutch the rotor for holding the rods and sheets in a locked position corresponding to selected tension achieved by rotating the crank). Note that dog 212*a* is received between housing shoulders 214 and 215 that block rotation of the dog about the clutch rotor axis 218.

Referring to FIG. 14, it shows the upper sheet (or grid) 122 in two sections—122' and 122'—each of which is independently tensioned in the same manner as described above as for example in FIGS. 12 and 13. The lower sheet or grid 132 is also in two sections, 132' and 132'', independently tensionable. Thus, sections 122' and 132' are tensioned by rotatable rod means 123' and 124' about which sheet extensions 122*a'* and 132*a'* are wrappable; and sections 122'' and 132'' are independently tensioned by rotatable rod means 123'' and 124'' about which sheet extensions 122*a'* and 132*a'* are wrappable. Mechanisms to rotate the rods are indicated generally at 220 and 220', each corresponding to that described above in FIGS. 9–11. This construction, as applied to a mattress, allows one sleeping portion of a mattress proximate 122' to be made adjustably "harder" than another sleeping portion proximate 122'' to accommodate to two users, as desired.

FIG. 15 shows an actuator 300 for tensioning the sheet extensions 122*a* and 132*a*. The actuator may be either hydraulic, electrical or pneumatic (or mechanical, as described above). Hydraulic or pneumatic fluid under pressure from a source 301 is admitted by a control valve 302 to operate the rotary motor 303 that rotates the two rods 123 and 124, about axis 400. The motor output rotor 304 corresponds to element 202 above.

Figure 13A:
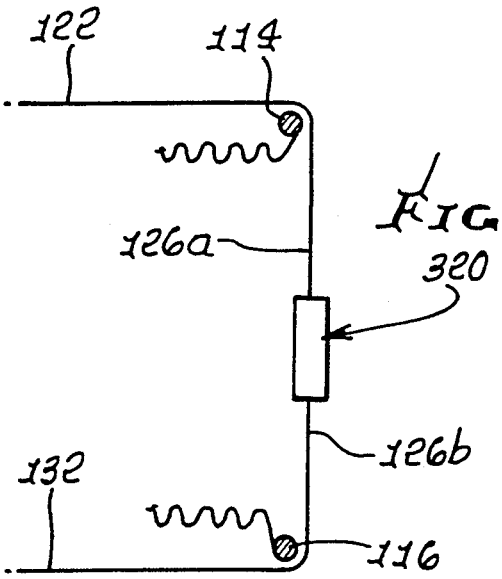
FIG. 13*a* is a modification.

FIG. 13*a* is like FIG. 13 but shows an adjustable means 320, generally, which exerts controllable tension on 126*a* and 126*b*; and 320 may be mechanical, pneumatic, electrical, or hydraulic. Controllable force or pressure is thus exerted on the top and bottom border wires creating surface tension, to modify the distribution of weight and load, as well as assist in creation of controlled muscular stretch, to decompress the body spine, disc areas, vertebrae, and associated musculature.

We claim:

1. In a body support device including upper and lower structures defining generally parallel planes, the improvement that comprises a) at least one of said upper and lower structures including a first tensionable member, b) first means extending at the periphery of the device and connected with the first tensionable member to interact therewith and transmit force for tensioning the tensionable member, c) means for adjusting the tension exerted by said first means, d) said c) means comprising a rotor operatively connected with said member, a rotor housing and means carried by the housing and operatively connectible with the rotor for blocking rotor rotation when the said member is tensioned and for allowing rotor rotation as during lessened tensioning of the member, said housing carried by said device.

2. The improvement of claim 1 wherein said tensionable member comprises a grid.

3. The improvement of claim 1 wherein the other of said upper and lower structures includes a second tensionable member.

4. The improvement of claim 3 wherein said second tensionable member is operatively connected with said first means so as to be adjustably tensionable in conjunction with adjustable tensioning of the first tensionable member.

5. The improvement of claim 1 wherein said second tensionable member comprises a sheet.

6. The improvement of claim 1 wherein said second tensionable member comprises a grid.

7. The improvement of claim 1 wherein said first tensionable member includes two sections, each independently tensioned by said c) means.

8. The improvement of claim 1 wherein said b) first means comprises rod means extending along the side of the device, and about which an extension of said first member is wrappable.

9. The improvement of claim 4 wherein said b) means comprises elongated rod mean extending along one side of the device and about which extensions of said first and second members ar wrappable.

10. The improvement of claim 9 wherein said device comprises a mattress.

11. The improvement of claim 1 wherein said device comprises a trampoline.

12. In a body support device including upper and lower structures defining generally parallel planes, the improvement that comprises a) at least one of said upper and lower structures including a first tensionable member, b) first means extending at the periphery of the mattress and connected with the first tensionable member to interact therewith and transmit force for tensioning the tensionable member, c) and means for adjusting the tension exerted by said first means, d) said second tensionable member being operatively connected with said first means so as to be adjustably tensionable in conjunction with adjustable tensioning of the first tensionable member, e) said b) means comprising elongated rod means extending along one side of the device and about which extensions of said first and second members are wrappable, f) said c) means comprising a clutch rotor connected with said rod means, a housing for said rotor, and manually manipulable dog means carried by the housing for engaging said rotor to prevent rotation thereof when the first and second members are tensioned, and for disengaging said rotor to allow rotation thereof as during decreased tensioning of said first and second members, said housing carried by said extensions.

13. The improvement of claim 12 including a crank having operative connection with said rotor to effect rotation thereof.

14. The improvement of claim 12 wherein said rotor has teeth engageable by said dog means to allow rotation of the rotor in one direction as during tensioning of said first member, and to block rotation of the rotor in the opposite direction unless the dog means is retracted relative to the rotor.

15. The improvement of claim 12 including second rod means extending along another side of the device, generally perpendicular to said one side of the device, and third and fourth tensionable members associated with said first and second structures and having extensions that are wrappable about said second rod means.

16. The improvement of claim 15 including a second clutch rotor associated with said second rod means, said housing also housing the second rotor, and second manually manipulable dog means carried by the housing for engaging the second rotor to prevent rotation thereof when the third and fourth members are tensioned, and for disengaging the rotor to allow rotation thereof as during decreasing tensioning of said third and fourth members.

17. The improvement of claim 8 wherein said rod means includes two parallel metallic rods.

18. The improvement of claim 15 wherein said first rod means includes two parallel rods, and said second rod means includes two parallel rods.

19. The improvement of claim 18 wherein said device comprises a mattress, said first rod means extending along one side of the mattress, and said second rod means extending along one end of the mattress.

20. The improvement of claim 1 wherein said c) means comprises actuator means.

21. The improvement of claim 20 wherein said actuator means comprises one of the following:

a) a mechanical means b) an hydraulic means c) a pneumatic means d) an electrical means.

22. A mattress having, in combination, a) first and second tensionable sleeping sections, b) and means to selectively adjust the hardness of at least one of said sleeping sections, c) said b) means comprising a rotor operatively connected with one of said sections, a rotor housing and means carried by the housing and operatively connectible with the rotor for blocking rotor rotation when said one section is tensioned and for allowing rotor rotation as during lessened tensioning of said one section, said housing carried by said mattress.

23. A mattress having, in combination, a) first and second sleeping sections respectively having first and second sheets, b) and means to selectively adjust the tensioning of at least one of said sheets, c) said b) means comprising a rotor operatively connected with said one sheet, a rotor housing and means carried by the housing and operatively connectible with the rotor for blocking rotor rotation when said one sheet is tensioned and for allowing rotor rotation as during lessened tensioning of said one sheet, said housing carried by said mattress.

* * * * *